US006318969B1

(12) United States Patent
Wang

(10) Patent No.: US 6,318,969 B1
(45) Date of Patent: Nov. 20, 2001

(54) FLOOR AIR PUMP

(76) Inventor: Lo-Pin Wang, 16F-2, No.17, Lane 52, Sec. 3, Re He Rd., Taichung (TW)

( * ) Notice: Subject to any disclaimer, the term of this patent is extended or adjusted under 35 U.S.C. 154(b) by 0 days.

(21) Appl. No.: 09/576,259

(22) Filed: May 24, 2000

(51) Int. Cl.[7] ..... F04B 1/00
(52) U.S. Cl. ..... 417/63; 417/527; 417/528
(58) Field of Search ..... 417/468, 469, 417/527, 528, 63, 440

(56) References Cited

U.S. PATENT DOCUMENTS

| | | | | |
|---|---|---|---|---|
| 1,484,549 | * | 2/1924 | Burnam | 417/528 |
| 1,491,388 | * | 4/1924 | Foster | 417/468 |
| 5,997,256 | * | 12/1999 | Gunther | 417/528 X |
| 6,027,319 | * | 2/2000 | Winefordner et al. | 417/528 X |
| 6,065,947 | * | 5/2000 | Wu | 417/527 X |
| 6,196,807 | * | 3/2001 | Wu | 417/63 |
| 6,227,810 | * | 5/2001 | Huang et al. | 417/63 |

* cited by examiner

*Primary Examiner*—Charles G. Freay
*Assistant Examiner*—David J. Torrente
(74) *Attorney, Agent, or Firm*—Browdy and Neimark

(57) ABSTRACT

A floor air pump comprises an outer tube, a pressure leaking device, a pressure gauge, and an air discharge tube. The outer tube is provided with two cylinders different in size from each other. The pressure leaking device is disposed in the lower end of the outer tube and is provided in the interior thereof with a receiving compartment in communication with the large cylinder. The receiving compartment is provided with a pressure leaking slide block, and at least two leakproof rings to keep the inner wall of the receiving compartment in the airtight state. The pressure leaking slide block is provided with an annular groove for forming a channel along with the pressure leaking slide block. The receiving compartment is provided therein with a spring to provide the pressure leaking slide block with a recovery force. The pressure gauge is disposed in the outer side of the outer tube such that the pressure gauge is in communication with the interior of the outer tube. The air discharge tube is disposed in one side of the pressure gauge for discharging the air so as to inflate an inflatable object.

6 Claims, 3 Drawing Sheets

FLOOR AIR PUMP

FIELD OF THE INVENTION

The present invention relates generally to an air pump, and more particularly to a floor air pump.

BACKGROUND OF THE INVENTION

The conventional air pump is provided with two cylinders of different sizes to speed up the inflating effect, and a switch which must be manually operated in the course of the operation of the air pump.

SUMMARY OF THE INVENTION

The primary objective of the present invention is to provide a floor air pump capable of automatic switching of the cylinders.

The floor air pump of the present invention comprises an outer tube, a pressure leaking device, a pressure gauge, and an air discharge tube. The outer tube is provided with two cylinders different in size from each other. The pressure leaking device is disposed in the lower end of the outer tube and is provided in the interior thereof with a receiving compartment in communication with the large cylinder. The receiving compartment is provided with a pressure leaking slide block, and at least two leakproof rings to keep the inner wall of the receiving compartment in the airtight state. The pressure leaking slide block is provided with an annular groove capable of forming a channel along with the movable pressure leaking slide block. The receiving compartment is provided therein with a spring to facilitate the position recovery of the pressure leaking slide block. The pressure gauge is disposed in the outer side of the outer tube such that the pressure gauge is in communication with the interior of the outer tube. The air discharge tube is disposed in one side of the pressure gauge for discharging the air so as to inflate an inflatable object.

DETAILED DESCRIPTION OF THE INVENTION

Figure 1:
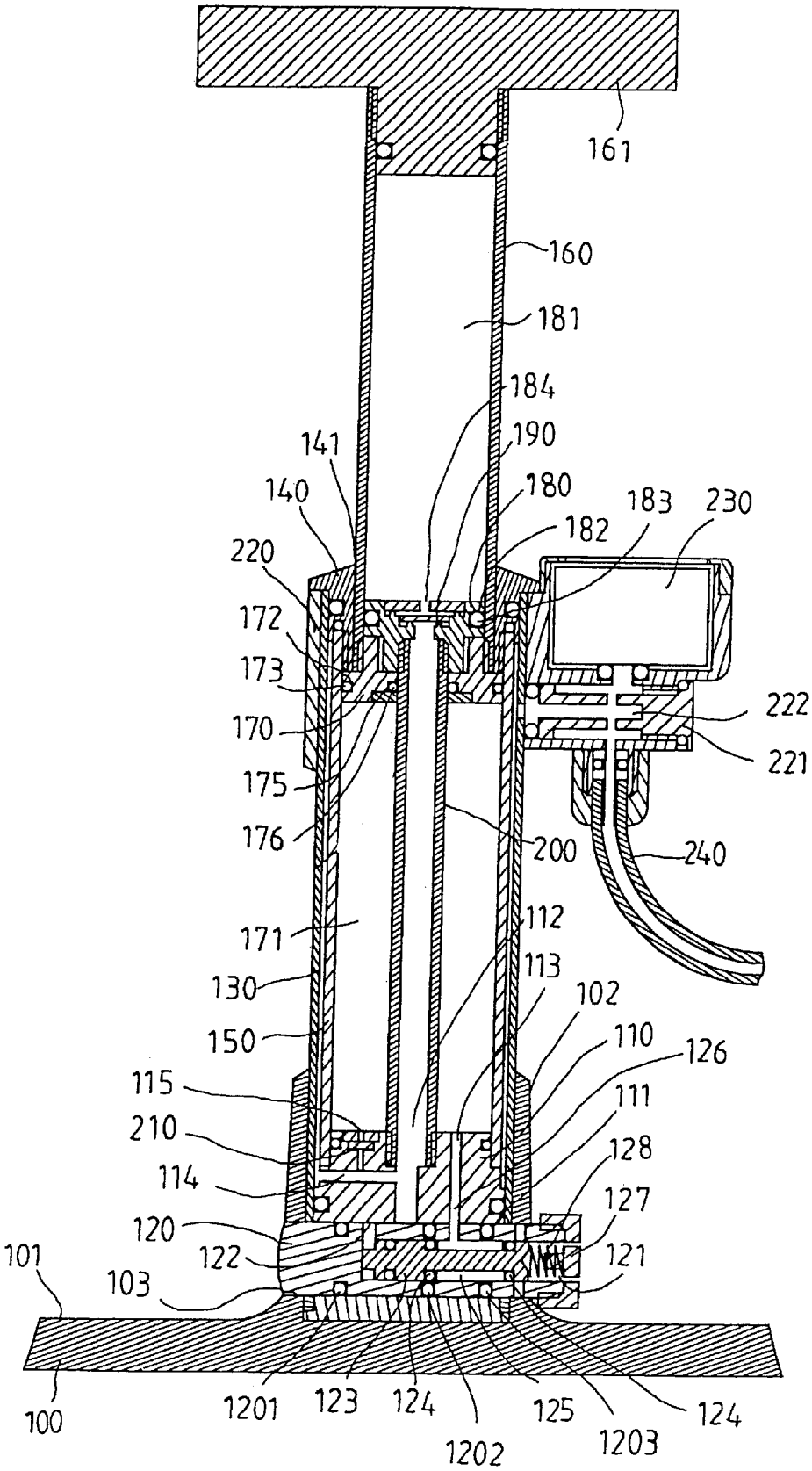
FIG. 1 shows a longitudinal sectional view of a preferred embodiment of the present invention.

As shown in FIG. 1, a floor air pump embodied in the present invention comprises the component parts, which are described hereinafter.

A base 100 has a support portion 101 which is provided in the center with a connection portion 102 of a cylindrical construction. The connection portion 102 is provided in the bottom with a through hole 103.

A seat 110 is disposed in the connection portion 102 and is provided with a through hole 111 corresponding in location to the through hole 103, and two through holes extending from the top thereof to the through hole 111 to form a first passageway 112 and an air leaking channel 113. A horizontal through hole 114 extends from the side of the seat 110 to the first passageway. A short through hole 115 extends from the top of the seat 110 to the horizontal through hole 114.

A pressure leaking device 120 is inserted at one end thereof into the connection portion 102 and the through holes 103 and 114 of the seat 110. The pressure leaking device is provided in the outer circular surface with three leakproof rings 1201, 1202, and 1203. The first passageway 112 is connected between the first leakproof ring 1201 and the second leakproof ring 1202. The pressure leaking device comprises a receiving compartment 121 which is provided in the bottom with a through hole 122 located between the first and the second leakproof rings so as to enable the receiving compartment to be in communication with the first passageway. The receiving compartment is provided with a pressure leaking slide block 123 movable in the receiving compartment. The pressure leaking slide block is provided in the outer circular surface with three leakproof rings 124 for keeping the receiving compartment 121 in the airtight state, as shown in FIG. 1, with the pressure leaking slide block located between the leakproof rings on the right being provided in the outer circular surface with an annular groove 125. The pressure leaking device is provided with a through hole 126 located between the second 1202 and the third leakproof ring 1203 for enabling the receiving compartment to be in communication with the air leaking channel 113. The exposed end of the receiving compartment 121 is fastened with a pressure leak adjustment button 127. A spring 128 is disposed in the receiving compartment such that the spring urges the slide block 123 and the adjustment button 127 for providing the slide block with a recovery force.

An outer tube 130 is disposed on the connection portion 102.

An upper cover 140 is disposed on the top end of the outer tube and is provided in the center with a through hole 141.

An outer cylinder 150 is disposed in the outer tube 130 such that the outer cylinder 150 is fastened at one end with the seat 110, and at other end thereof with the lower end of the upper cover 140.

An inner cylinder 160 is disposed at one end thereof in the outer cylinder 150 such that other end thereof is fastened with a handle 161 via the through hole 141 of the upper cover.

An outer cylinder piston 170 is disposed in the bottom of the inner cylinder 160 to enable the outer cylinder piston and the seat 110 to form therebetween a first pressure space 171. The outer cylinder piston is provided in the outer peripheral surface with an annular groove 172 which is provided with a leakproof ring 173, thereby enabling the outer cylinder piston and the inner wall surface of the outer cylinder 150 to form a one-way air admission valve, so as to let air enter the first pressure space without flowing in reverse. This is similar to the conventional air pump. The outer cylinder piston is provided in the center with a through hole 174 which is provided in the inner wall with an annular groove 175 for locating a leakproof ring 176.

An inner cylinder piston 180 is disposed in the inner cylinder 160 such that a second pressure space 181 is formed between the inner cylinder piston and the handle 161. The inner cylinder piston is provided in the outer peripheral surface with an annular groove 182 for locating a leakproof ring 183, thereby enabling the inner cylinder piston and the air tight inner wall of the inner cylinder 160 to form a one-way air admission valve. The air enters the second air pressure space without flowing in reverse. This is similar to the conventional air pump. The inner cylinder piston is provided in the center with a guide hole 184.

A check valve 190 is disposed in the guide hole 184 to enable air to flow into the guide hole from the second pressure space without flowing in reverse.

A guide tube 200 is connected between the first passageway 112 of the seat 110 and the inner cylinder piston 180 via the through hole 174 of the outer cylinder piston such that the guide tube 200 is in communication with the guide hole 184 of the inner cylinder piston.

The horizontal through hole 114 is in communication with the first passageway 112 to the space of the outer portion of the outer cylinder 150 so as to form a second passageway.

The short through hole 115 is in communication with the first pressure space 171 of the outer cylinder piston to the second passageway to form an output channel.

A check valve 210 is disposed in the short through hole 115 to enable air to flow outward from the first pressure space without flowing backward.

A pressure gauge mount 220 is disposed in the outer side of the top end of the outer tube 130 and is provided in one side with a mounting portion 221 which is in turn provided in the interior thereof with a three-way tube 222. The three-way tube has one end in communication with the interior space of the outer tube 130.

A pressure gauge 230 is the same as the conventional pressure gauge and is mounted on the mounting portion 221 such that the pressure gauge is in communication with other end of the three-way tube 222.

An air discharging tube 240 is disposed in one side of the mounting portion 221 and is in communication with the third end of the three-way tube 222 and the air valve of an inflatable object being inflated.

As shown in FIG. 1, the handle 161 and the inner cylinder 160 are pressed downward from the position as shown in FIG. 1, thereby causing the outer cylinder piston 170 to compress the air in the first pressure space 171. The air is forced to enter the outer space of the outer cylinder 150 via the check valve 210 of the seat output channel. The air is discharged from the air discharging tube 240 via the pressure gauge mount 220. In the meantime, the handle 161 descends to enable the inner cylinder piston 180 to compress the air in the second pressure space 181. The air enters the guide tube 200 via the guide hole 184 and the check valve 190 before entering the outer space of the outer cylinder 150 via the second passageway 114. The air is finally discharged from the air discharging tube 240. In the meantime, the atmospheric air enters the outer cylinder 150 via the interstice between the inner cylinder 160 and the upper cover through hole 141 such that the air enters the inner cylinder 160 via the gap between the inner cylinder 160 and the outer cylinder piston 170.

Figure 2:
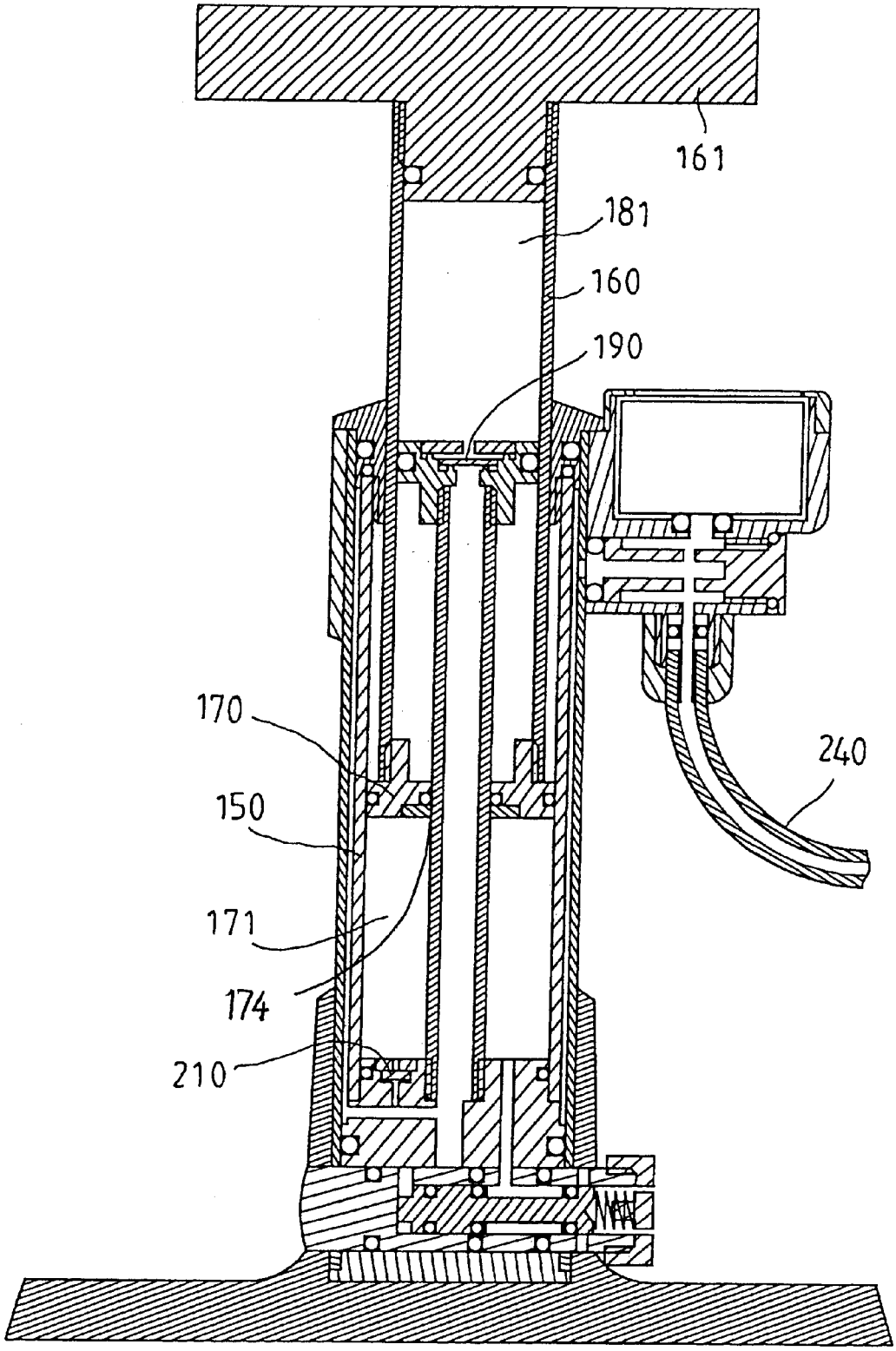
FIGS. 2 and 3 are longitudinal sectional views of the preferred embodiment of the present invention in action.

As shown in FIG. 2, when the handle 161 is pulled upward, the bottom space of the outer cylinder 150 becomes larger such that the pressure in the space becomes smaller. As a result, the air in the upper section of the outer cylinder is drawn into the first pressure space 171 of the lower section of the outer cylinder via the one-way air valve of the outer periphery of the outer cylinder piston 170. Similarly, the air in the lower section of the inner cylinder 160 is drawn into the second pressure space 181 of the upper section of the inner cylinder via the one-way air valve of the outer periphery of the inner cylinder piston 180. The air injected into the outer space of the outer cylinder 150 and the air discharging tube 240 is prevented from flowing in reverse by the output channel check valve 210 and the inner cylinder check valve 190.

Figure 3:
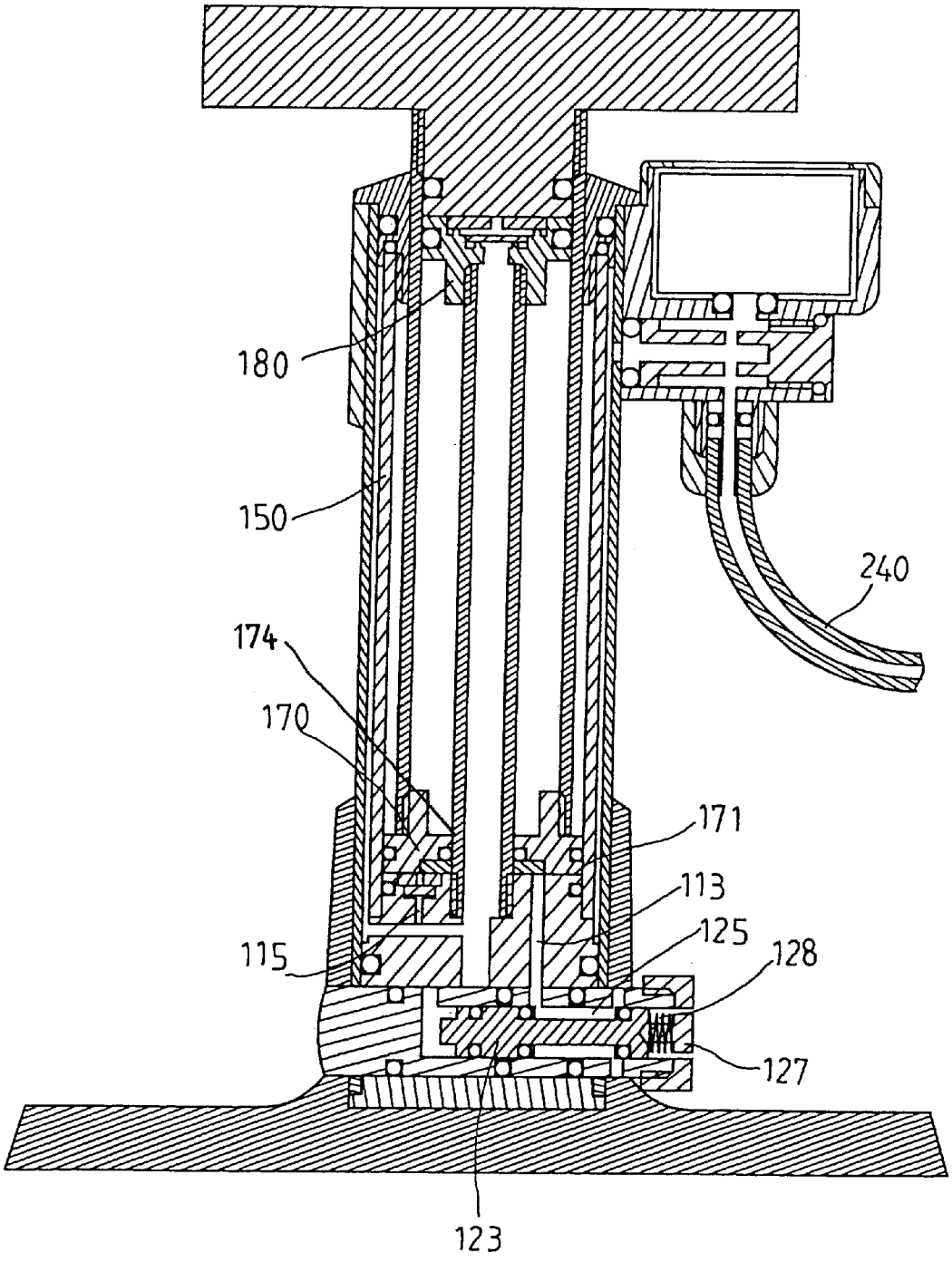

As shown in FIG. 3, the air pressure in the air discharging tube 240 and the outer space of the outer cylinder 150 becomes greater in the midst of the inflating process. As a result, the air pressure forces the pressure leaking slide block 123 to move toward the pressure leaking adjustment button 127 so as to compress the spring 128 until such time when the air pressure in the air discharging tube reaches a predetermined value. The pressure leaking slide block 123 is forced to move toward the pressure leaking adjustment button 127 for a predetermined distance, so as to enable the outer cylinder 150, the air leaking channel 113 and the annular groove 125 of the pressure leaking slide block to form a channel in communication with the atmospheric air. The air, which is compressed in the first pressure space 171 by the outer cylinder piston 170, is then let out via the channel without entering the output channel 115 to become an invalid piston at high pressure. As the user continues pumping, the inflating action is carried out by the inner cylinder piston 180 which has a smaller force exertion area, thereby attaining the automatic adjustment of the air pump of the present invention.

The present invention can be used in a variety of situations in view of the fact that the air pressure can be set at a predetermined value by adjusting the engagement depth of the pressure leaking adjustment button so as to control the magnitude of force exerting on the spring.

What is claimed is:

1. A floor air pump comprising:

a base;

a seat disposed on said base;

a pressure leaking device disposed in said seat and provided with a receiving compartment in which a pressure leaking slide block is slidably disposed, said pressure leaking slide block provided with a channel capable of being opened or closed by said slide block in motion, said receiving compartment provided with a spring for providing said pressure leaking slide block with a recovery force;

an outer tube disposed on said base;

an upper cover disposed on the top end of said outer tube and provided in the center thereof with a through hole;

an outer cylinder disposed in said outer tube such that said outer cylinder is connected at one end thereof with said seat, and other end thereof with a lower end of said upper cover;

an inner cylinder received at one end thereof in said outer cylinder such that other end of said inner cylinder is exposed via said through hole of said upper cover and is provided with a handle unabling a user to pull said inner cylinder to move along the longitudinal direction of said outer cylinder;

an outer cylinder piston disposed in the bottom end of said inner cylinder and fitted into said outer cylinder, said outer cylinder piston and said seat forming therebetween a first pressure space, said outer cylinder piston provided in the outer periphery with a one-way air admission valve enabling air to enter said first pressure space in a one-way manner, said outer cylinder piston provided in a center thereof with a through hole whereby said through hole is provided in the inner wall thereof with at least one leakproof ring;

an inner cylinder piston disposed in said inner cylinder such that said inner cylinder piston and said handle form therebetween a second pressure space, said inner cylinder piston provided in the outer periphery thereof with a one-way air admission valve enabling air to enter said second pressure space in a one-way manner, said inner cylinder piston provided in a center thereof with a guide hole;

a check valve disposed in said guide hole of said inner cylinder piston to enable air to enter said guide hole in a one-way manner from said second pressure space;

a guide tube connected between said seat and said guide hole of said inner cylinder piston such that said guide tube is put through said through hole of said outer cylinder piston;

an air leaking channel disposed in said seat to connect said receiving compartment of said pressure leaking device with said first pressure space of said outer cylinder;

a first passageway disposed in said seat to connect said guide tube with said receiving compartment of said pressure leaking device;

a second passageway disposed in said seat to connect said first passageway with said outer cylinder outer space;

an output channel disposed in said seat to connect said first pressure space of said outer cylinder with said second passageway;

a check valve disposed in said output channel to enable air to flow outward in a one-way manner from said first pressure space;

a pressure gauge disposed in the outer side of said outer tube such that said pressure gauge is in communication with the interior of said outer tube; and an air discharging tube in communication with said pressure gauge and the air valve of an inflatable object being inflated.

2. The floor air pump as defined in claim 1, wherein said receiving compartment of said pressure leaking device is provided at other end thereof with a pressure leaking adjustment button fastened therewith; wherein said spring urges said pressure leaking slide block and said pressure leaking adjustment button for providing said pressure leaking slide block with a recovery force.

3. The floor air pump as defined in claim 1, wherein said pressure leaking slide block is provided in an outer circular surface thereof with at least two leakproof rings to make said pressure leaking slide block and the inner wall of said receiving compartment airtight, said pressure leaking slide block further provided in the outer circular surface thereof with an annular groove to form said channel.

4. The floor air pump as defined in claim 1 further comprising a pressure gauge mount which is disposed in the outer side of the top end of said outer tube and is provided in one side with a mounting portion; wherein said pressure gauge is mounted on said mounting portion.

5. The floor air pump as defined in claim 4, wherein said pressure gauge mount is provided in the interior with a three-way tube which is connected at a first end thereof with the interior of said outer tube, at a second end thereof with said pressure gauge, and at a third end thereof with said air discharging tube whereby said air discharging tube is disposed at other end of said mounting portion.

6. The floor air pump as defined in claim 1, wherein said outer cylinder is fastened with the lower end of said upper cover.

* * * * *